United States Patent [19]

Mitsuyama

[11] Patent Number: 4,988,038

[45] Date of Patent: Jan. 29, 1991

[54] DOCUMENT FILE

[76] Inventor: Masuhiro Mitsuyama, 1071, Kinugasa, Wake-cho, Wake-gun, Okayama, Japan

[21] Appl. No.: 412,321

[22] Filed: Sep. 25, 1989

[51] Int. Cl.[5] ..... B65D 3/00

[52] U.S. Cl. ..... 229/1.5 R; 229/72; 190/902

[58] Field of Search ..... 281/31, 40; 190/125, 190/900, 901, 902; 402/78; 229/1.5 R, 72; 150/130

[56] References Cited

U.S. PATENT DOCUMENTS

| | | | |
|---|---|---|---|
| 508,394 | 11/1893 | Andrews | 229/72 X |
| 510,350 | 12/1893 | Lochmann | 229/72 X |
| 635,582 | 10/1899 | Pedrick | 229/72 X |
| 720,324 | 2/1903 | Bushnell, Jr. | 229/72 |
| 1,694,186 | 12/1928 | L'Enfant | 281/31 |
| 1,983,036 | 12/1934 | Kaufmann | 190/901 X |
| 2,330,402 | 9/1943 | Winokar | 229/72 |
| 2,333,523 | 11/1943 | Cohun | 190/902 X |
| 3,008,470 | 11/1961 | Rubinstein | 402/78 |
| 4,629,349 | 12/1986 | Pitts | 281/31 X |
| 4,764,159 | 8/1988 | Mitsuyama | 493/947 X |
| 4,790,474 | 12/1988 | Mitsuyama | 229/1.5 R |

FOREIGN PATENT DOCUMENTS

| | | | |
|---|---|---|---|
| 2257435 | 8/1975 | France | 229/1.5 R |

*Primary Examiner*—Stephen P. Garbe
*Assistant Examiner*—Jes F. Pascua
*Attorney, Agent, or Firm*—Wenderoth, Lind & Ponack

[57] ABSTRACT

A document file in which a plurality of compartments formed of soft synthetic resin sheet material are connected contiguously in an accordion-like fashion and mounted between a pair of covers includes auxiliary sheets attached along both side edges and a bottom edge to each of the covers. Each of the covers includes a thick paper pad mounted between the two resin sheets. The pads are laterally shorter than the resin sheets and mounted so as to leave spaces at the end portions thereof so that side edges of the cover can be bent inward like a bow such that the auxiliary sheet buckles away from the cover and forms an opening at the top edge portion thereof. In addition, when both side edges of the covers retreat to their original position, the top edge of the auxiliary sheet becomes tightly sealed against the cover so as to prevent contents contained therebetween from coming out of the opening.

6 Claims, 2 Drawing Sheets

FIG. 5 - PRIOR ART

DOCUMENT FILE

BACKGROUND OF THE INVENTION

The present invention relates to a document file, and more particularly, to a document file which comprises a plurality of upwardly opening compartments attached together in an accordion-like fashion.

Conventionally, as disclosed in the Japanese Unexamined Utility Model Publication No. 61-175481, this kind of document file comprises a pair of covers and a plurality of compartments formed of synthetic resin sheets and sealed to the covers so as to accommodate papers.

As shown in FIG. 5, a cover 1' (which may be a front cover or rear cover) of the conventional type of file has a thick paper pad 2' enclosed between two synthetic resin sheets 5'. Both lateral ends 3', 4' of the thick pad 2' reach the location at which the side edges of the resin sheet 4 are connected together, thereby filling the entire space between the resin sheets. An auxiliary resin sheet 6' is connected to one of the resin sheets 5' of the cover 1' and a plurality of contiguous synthetic resin compartments are attached to the auxiliary sheet 6'.

Because in the conventional file, both ends 3' and 4' of the pad 2' reach the side edges of the synthetic resin sheets 5', such that no open space is defined between end portions of the resin sheets 5' and both ends 3' and 4' of the padding 2', the side edges of the cover 1' cannot be easily bent. Therefore, in order to provide for the insertion of papers between the lower (as shown in FIG. 5) of the two resin sheets 5' and the auxiliary sheet 6', it has been necessary to rigidify the corners 8' of the auxiliary sheet 6'; for example by use of gussets, so as to maintain all but the bottom and side edges of the sheet 6' spaced from resin sheet 5' and allow papers to be inserted therebetween.

Although this design allows papers to be inserted between the auxiliary sheet 6' and the adjacent resin sheet 5', the fact that it is necessary to rigidify the corners 8' creates difficulties in production of the document file.

SUMMARY OF THE INVENTION

Accordingly, it is an object of the present invention to provide a document file having a cover formed of two synthetic resin sheets and a thick pad mounted therebetween, and an auxiliary sheet, wherein papers can be easily inserted between the auxiliary sheet and the adjacent synthetic resin sheet, but for which it is unnecessary to rigidify corners of the auxiliary sheet.

This object is achieved according to the present invention by providing a document file formed of a plurality of upwardly opening compartments attached together in accordion-like fashion and front and rear covers attached to respectively opposing end compartments of the plurality of compartments. Each of the front and rear covers is formed of two synthetic resin sheets with a thick paper pad mounted therebetween. The thick pad is laterally shorter than the two synthetic resin sheets and is mounted such that spaces are formed between the thick pad and the locations along which the synthetic resin sheets are attached together. An auxiliary sheet is attached along both side edges and a bottom edge to one of the synthetic sheets of each cover such that it is interposed between the respective cover and the corresponding end compartment of the plurality of upwardly opening compartments and mounted flat against the cover.

The spaces formed on opposing lateral sides of each of the thick pads allow the end portions of the covers to be easily bent toward the plurality of compartments, thereby causing the respective auxiliary sheet to buckle away from the adjacent cover, such that papers can be inserted therebetween.

As a result, this kind of document file according to the present invention can be manufactured very easily.

BRIEF DESCRIPTION OF THE DRAWINGS

FIG. 5 is a transverse sectional view of the cover of a conventional document file.

DETAILED DESCRIPTION OF THE INVENTION

Examples according to the present invention will be explained below with reference to FIGS. 1 through 4 of the accompanying drawings.

Figure 1:
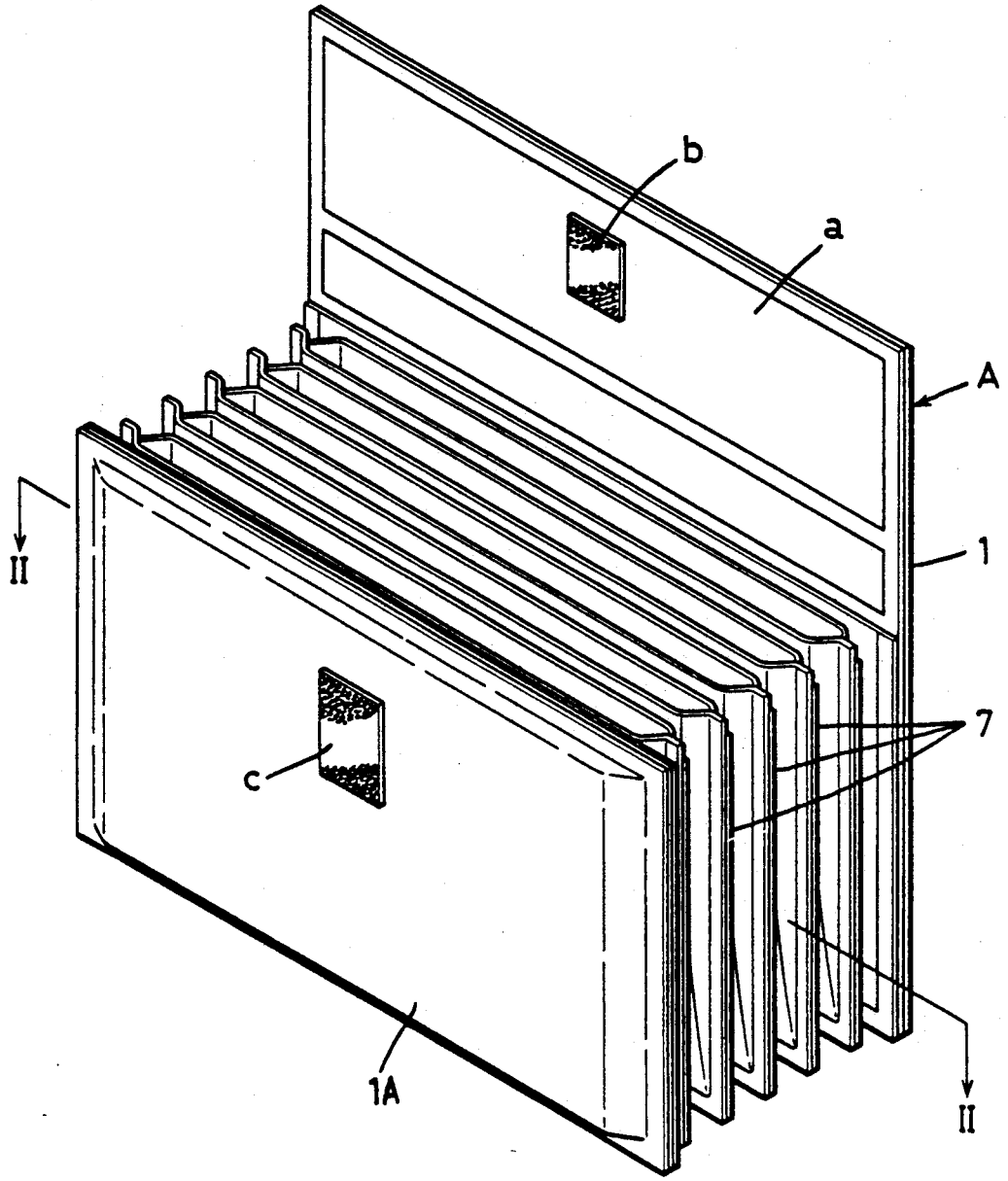
FIG. 1 is a perspective view of the document file having the covers according to the present invention.

The document file A, as shown in FIG. 1, comprises between the covers 1 and 1A a plurality of upwardly opening compartments 7, 7 ... made of soft synthetic resin sheet material connected in accordion-like fashion to provide for storage of papers or cards. The fastener b on the flap a and the fastener c on the front cover 1A serve to close the top opening of the file A.

Figure 2:
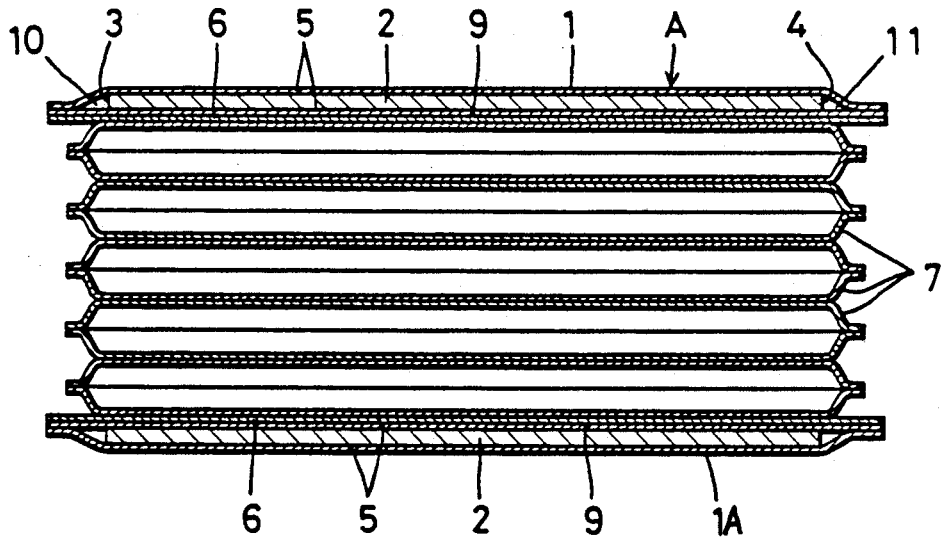
FIG. 2 is a transverse sectional view taken along the line II—II of FIG. 1.
Figure 3:
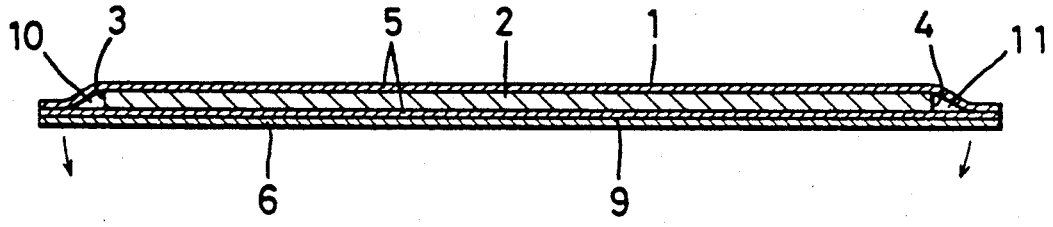
FIG. 3 is a transverse sectional view of one of the covers.

Auxiliary sheets 6 are attached directly to the outermost covers 1 and 1A respectively along all edges except the top edge 9 which is in tight-sealed condition with respect to the covers, as shown in FIGS. 2 and 3.

Figure 4:
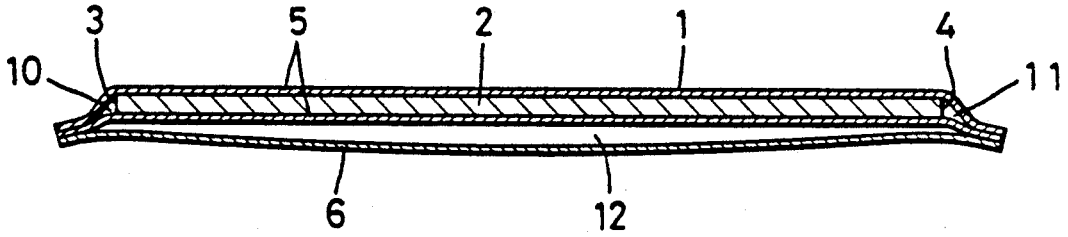
FIG. 4 is a transverse sectional view showing both side edges of the cover of FIG. 3 being curved in the direction of the arrows.
Figure 4:
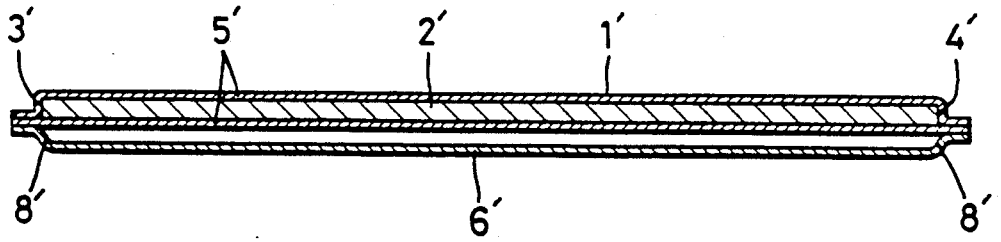

Each of the covers 1 and 1A include two synthetic resin sheets 5 (see FIGS. 2–4) and a thick paper pad 2 which is laterally shorter than the sheets 5 such that padding-free portions (or spaces) 10 and 11 are defined at the ends 3 and 4 of the pads 2, thereby making it easier to bend inwardly the side edges of the covers 1 and 1A like a bow, as shown in FIG. 4. Accordingly, the top edge 9 of the auxiliary sheet 6 can be easily separated to form opening 12.

Moreover, when both side edges of the covers 1 and 1A retreat to their original positions, the top open edge 9 of the auxiliary sheet 6 becomes tightly sealed against its corresponding cover to prevent contents contained therebetween from coming out of the open opening 12.

I claim:

1. A document file comprising:

a first cover formed of two sheets attached together at locations along bottom edges and both side edges thereof, and a first thick pad mounted therebetween said two sheets of said first cover, said first thick pad being laterally shorter than said two sheets of said first cover and being mounted between said two sheets of said first cover such that spaces are respectively formed between said first thick pad and each of said locations along which said side edges are attached together an auxiliary sheet attached at both side edges thereof to both side edges, respectively, of one of said two sheets of said first cover in such a manner that said auxiliary sheet is normally disposed flat against said one of said two sheets of said first cover; and a plurality of upwardly opening compartments attached together in accordion-like fashion, a first end compartment of said plurality of upwardly opening compartments being attached to said auxiliary sheet.

2. A document file as recited in claim 1, further comprising a second cover formed of two sheets attached together at locations along bottom edges and both side edges thereof, and a second thick pad mounted between said two sheets of said second cover, said second thick pad being laterally shorter than said two sheets of said second cover and being mounted between said two sheets of said second cover such that spaces are respectively formed between said second thick pad and each of said locations along which said side edges are attached together said second cover being attached to a second end compartment of said plurality of upwardly opening compartments.

3. A document file as recited in claim 2, wherein each of said two sheets of said first cover and each of said two sheets of said second cover comprises a synthetic resin sheet.

4. A document as recited in claim 2, wherein each of said first and second thick pads comprises a thick paper pad.

5. A document file as recited in claim 1, wherein each of said two sheets of said first cover member comprises a synthetic resin sheet.

6. A document file as recited in claim 1, wherein said first thick pad comprises a thick paper pad.

* * * * *